US006343390B1

(12) United States Patent
Yang et al.

(10) Patent No.: US 6,343,390 B1
(45) Date of Patent: Feb. 5, 2002

(54) FOLDABLE PLAYYARD

(75) Inventors: Cheng-Fang Yang, Tainan; Chien-Chih Wang, Cha-I, both of (TW)

(73) Assignee: Link Treasure Limited, Tortola (BV)

( * ) Notice: Subject to any disclaimer, the term of this patent is extended or adjusted under 35 U.S.C. 154(b) by 0 days.

(21) Appl. No.: 09/540,185

(22) Filed: Mar. 31, 2000

(51) Int. Cl.[7] ..... A47D 7/00
(52) U.S. Cl. ..... 5/99.1; 5/98.1
(58) Field of Search ..... 5/93.1, 98.1, 98.3, 5/99.1

(56) References Cited

U.S. PATENT DOCUMENTS 5,454,124 A * 10/1995 Huang ..... 5/99.1
5,867,851 A * 2/1999 Mariol et al. ..... 5/99.1
5,906,014 A * 5/1999 Zhuang ..... 5/99.1
5,911,653 A * 6/1999 Cheng ..... 5/99.1
5,970,540 A * 10/1999 Cheng ..... 5/98.1

* cited by examiner

*Primary Examiner*—Michael F. Trettel
(74) *Attorney, Agent, or Firm*—W. Wayne Liauh

(57) ABSTRACT

The present invention relates to a foldable playyard for an infant, which is capable of expanding for play use and folding up for downsizing and benefiting storage. The present invention introduce a safety pin located at the joint element of lower frame of the foldable playyard. The safety pin will play an important role on keeping the foldable playyard in its expanding status, and will prevent the foldable playyard from malfunction which causes an unwanted folding up. The safety pin can also carry a pulled element to a released position and unlock the restrict of the joint element. The foldable playyard comes to foldable again.

10 Claims, 8 Drawing Sheets

FOLDABLE PLAYYARD

BACKGROUND OF THE INVENTION

1. Field of Invention

The present invention relates generally to a foldable playyard for an infant to play inside, which is capable of offering an expanded space for leisure use but can be folded to reduce its size for storage and portable carrying.

2. Related Art

A foldable playyard is typically provided to form a safe place for an infant to play inside, and a conventional foldable playyard is normally composed of a plurality of tubular rod 401 and 402 and connecting joints 403 and 404, and these components construct a foldable frame, as shown in FIG. 1. The frame can both expand to form a play space and be folded up for easy storage. The frame is further composed of an upper frame 41 and a lower frame 42. Generally, a locking device 4031 is equipped with the connecting joint 403 of the upper frame 41 while only the connecting joint 404 of the lower frame 42 is supplied for connecting a tubular rod 402. The locking device 4031 will keep the tubular rods of the upper frame 41 in an expanded status while the lower frame keeps its expanded status by its weight and/or that of the infant's. After the locking device of the upper frame is released, the frame becomes foldable. The lower frame also becomes foldable after it is pulled up.

There are not any other locking devices equipped with conventional lower frame. This may become dangerous when someone accidentally applies a force on the foldable playyard since it will not ensure safety of the infant inside.

The foregoing has outlined some of the more pertinent objects of the present invention. These objects should be construed to be merely illustrative of some of the more prominent features and applications of the intended invention. Many other beneficial results could be obtained by applying the disclosed invention in a different manner or modifying the invention within the scope of the disclosure. Accordingly, other objects and a fuller understanding of the invention may be had by referring to the summary of the invention and detailed description of the preferred embodiment in addition to the scope of the invention as defined by the claims taken in conjunction with the accompanying drawings.

SUMMARY OF THE INVENTION

Accordingly, the present invention provides mainly a foldable playyard for an infant, especially a foldable playyard which can prevent unwanted folding and thus ensure the safety of an infant.

A safety pin is introduced in the connecting joint of the lower frame in order to securely maintain the rods in a normally expanded status and prevent them from accidental folding. Every safety pin of the connecting joint is connected to a operating handle by a pulled element. Pulling action of the operating handle will release every safety pin simultaneously, and the lower frame becomes foldable.

These and other features of the present invention will become more fully apparent from the following description and dependent claims taken in conjunction with the accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein:

FIG. 4A is an enlarged cutting view of the detailed structure of the joint element of the present invention.

DETAILED DESCRIPTION OF THE INVENTION

Figure 1:
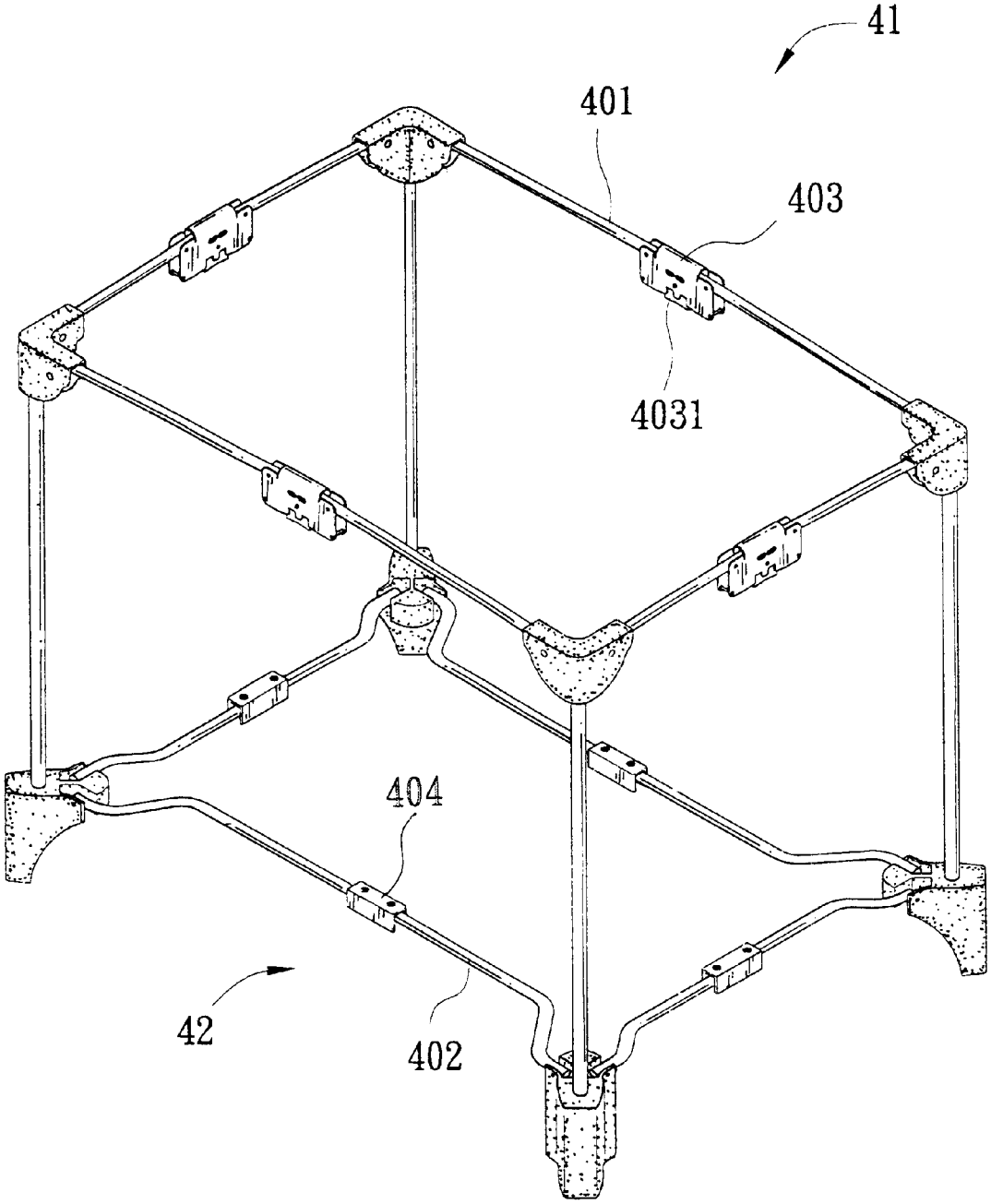
FIG. 1 (PRIOR ART)
FIG. 1 is a perspective view of conventional foldable playyard for an infant.
Figure 2:
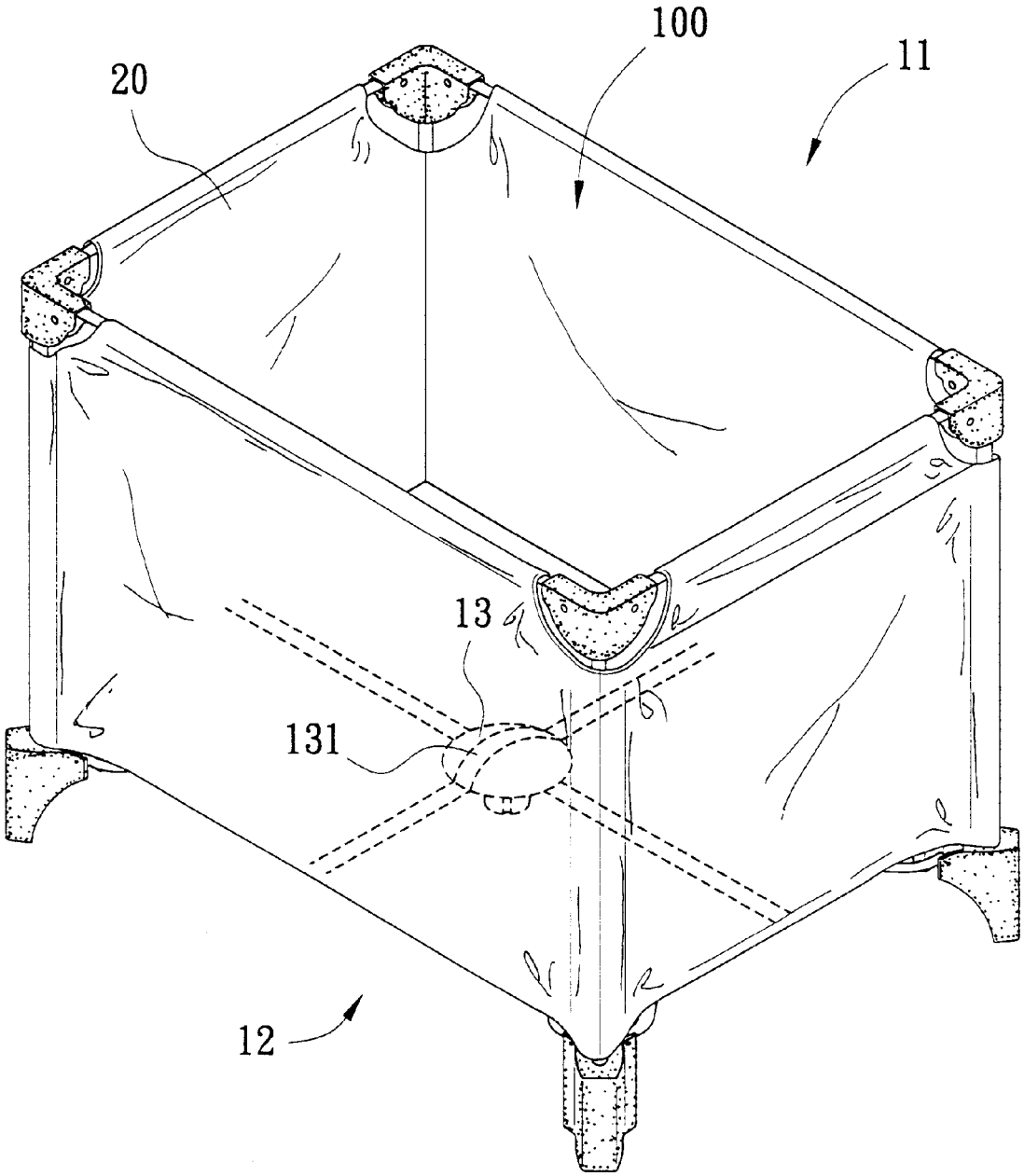
FIG. 2 is a perspective view of the present invention, foldable playyard.
Figure 3:
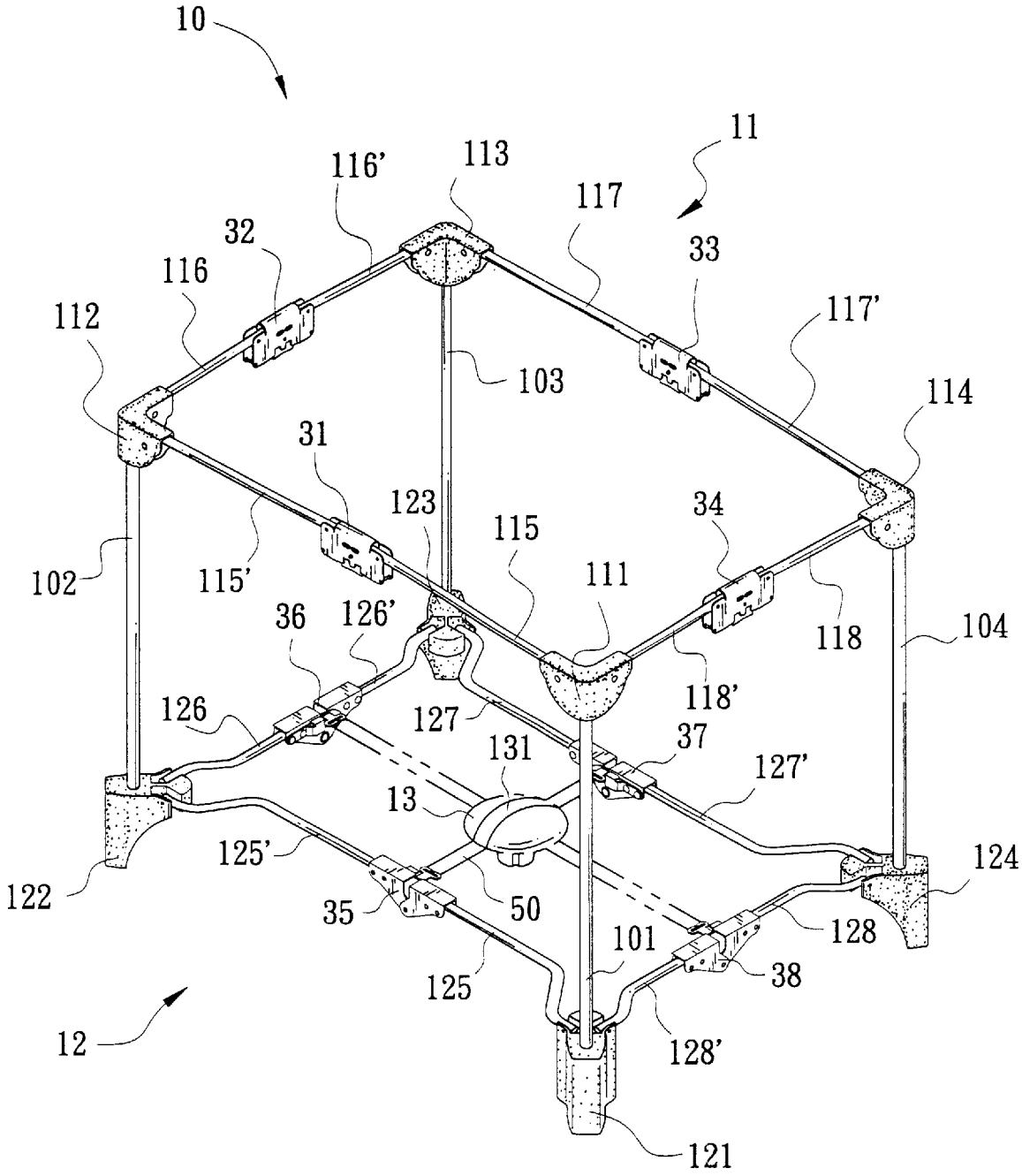
FIG. 3 is a perspective view of the present invention, foldable playyard, depicting the main frame structure.
Figure 4A:
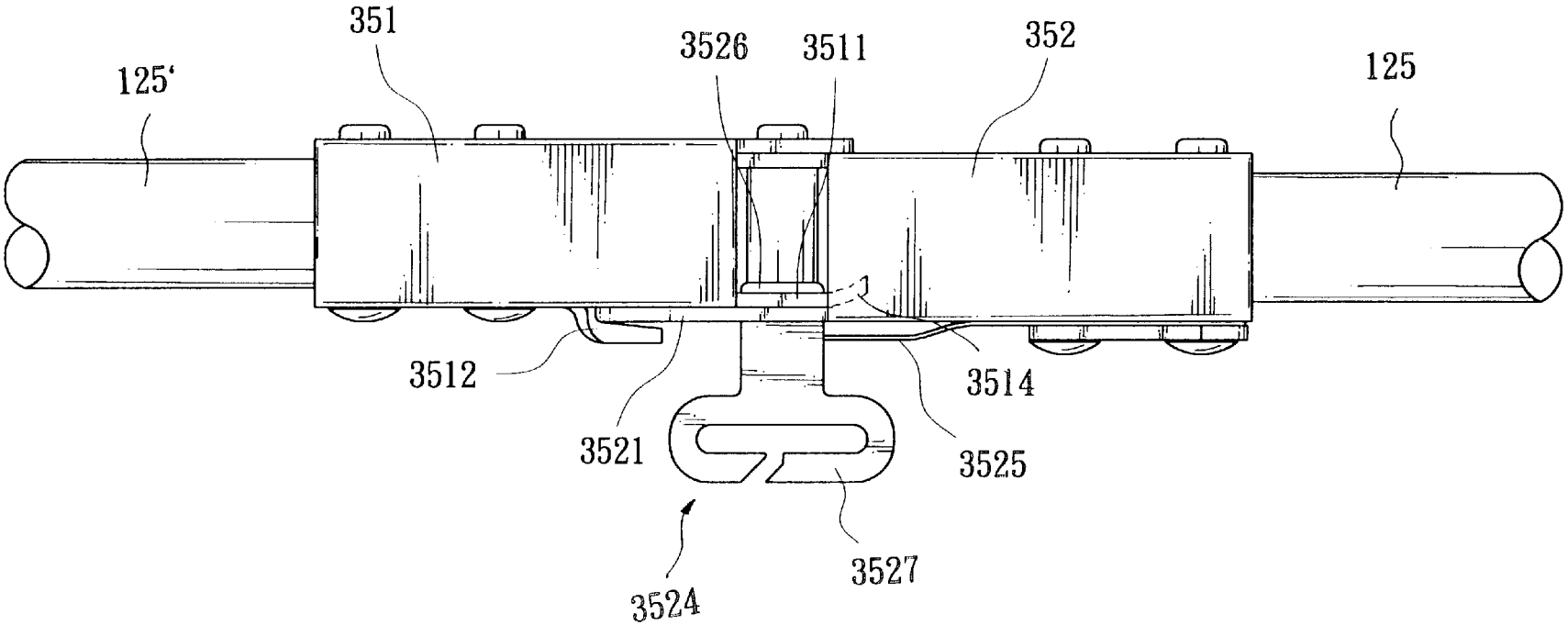
FIG. 4A is an enlarged view of the detailed structure of the joint element of the present invention.
Figure 4B:
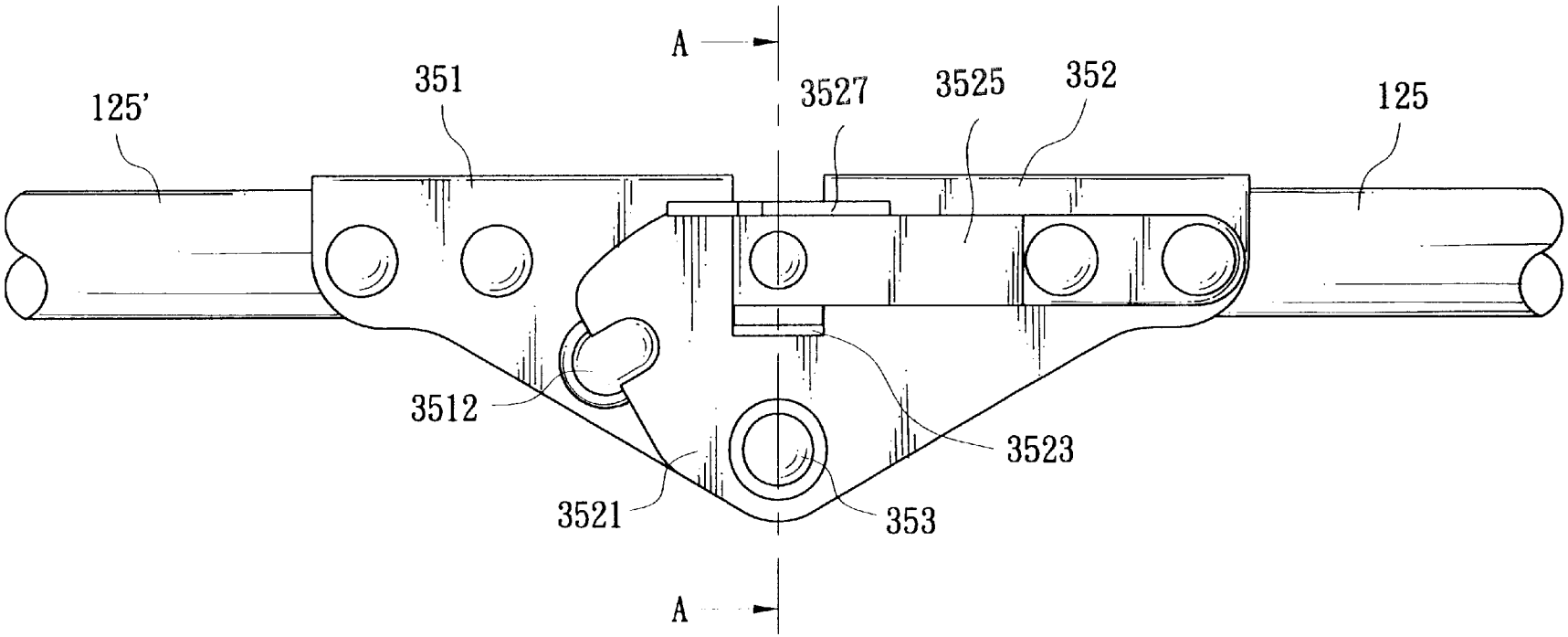
FIG. 4B is an enlarged side view of the detailed structure of the joint element of the present invention.
Figure 4C:
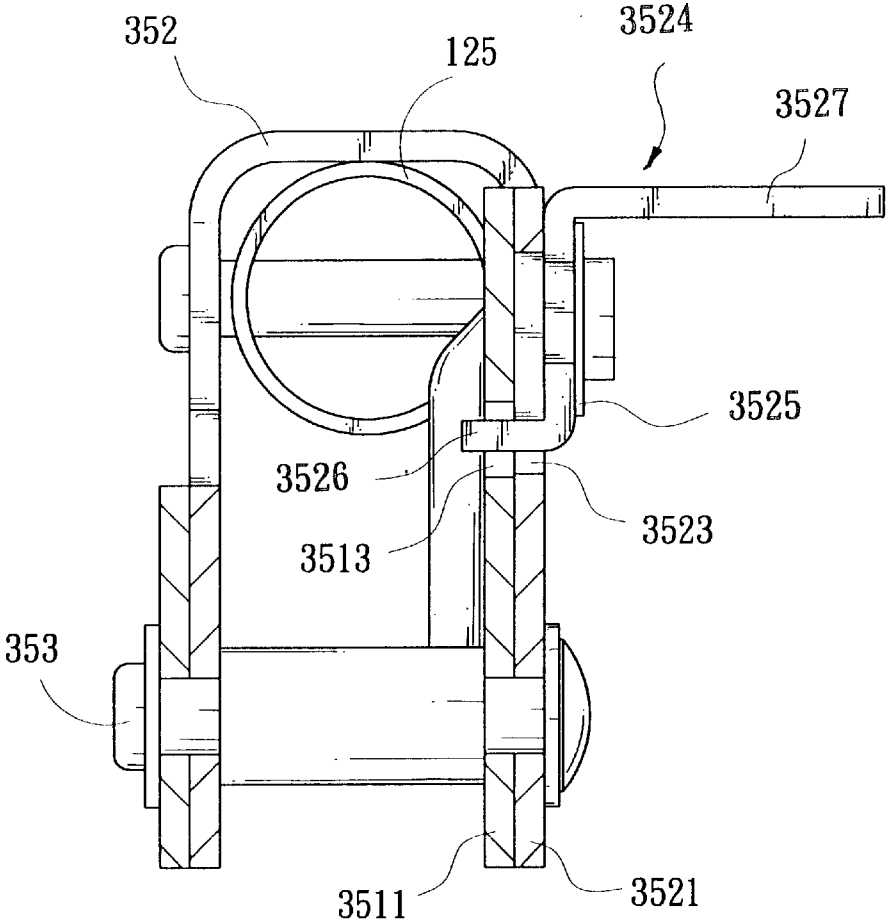
Figure 5A:
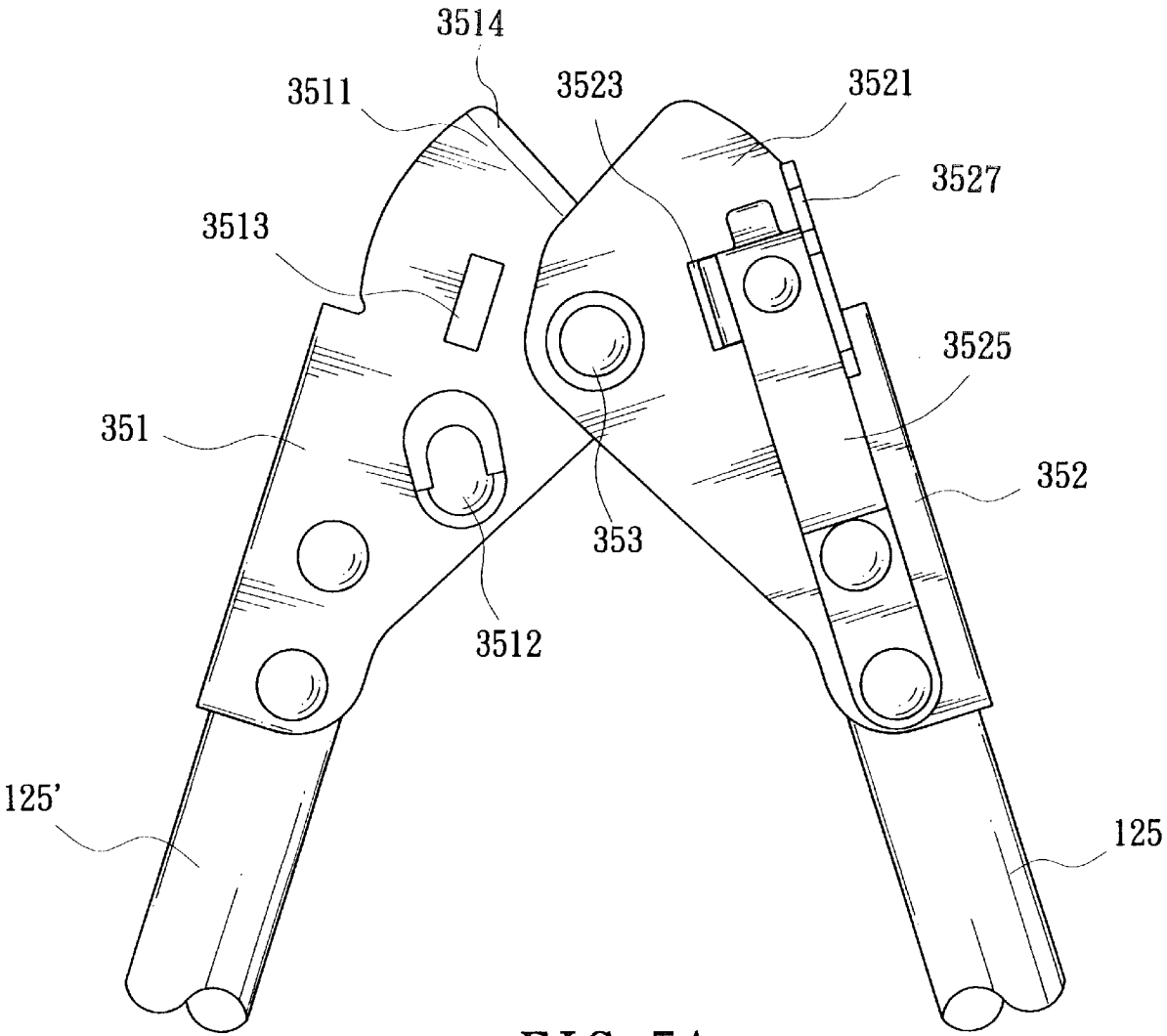
FIG. 5A is an enlarged view of the detailed structure of the joint element of the present invention, depicting the folded position.
Figure 5B:
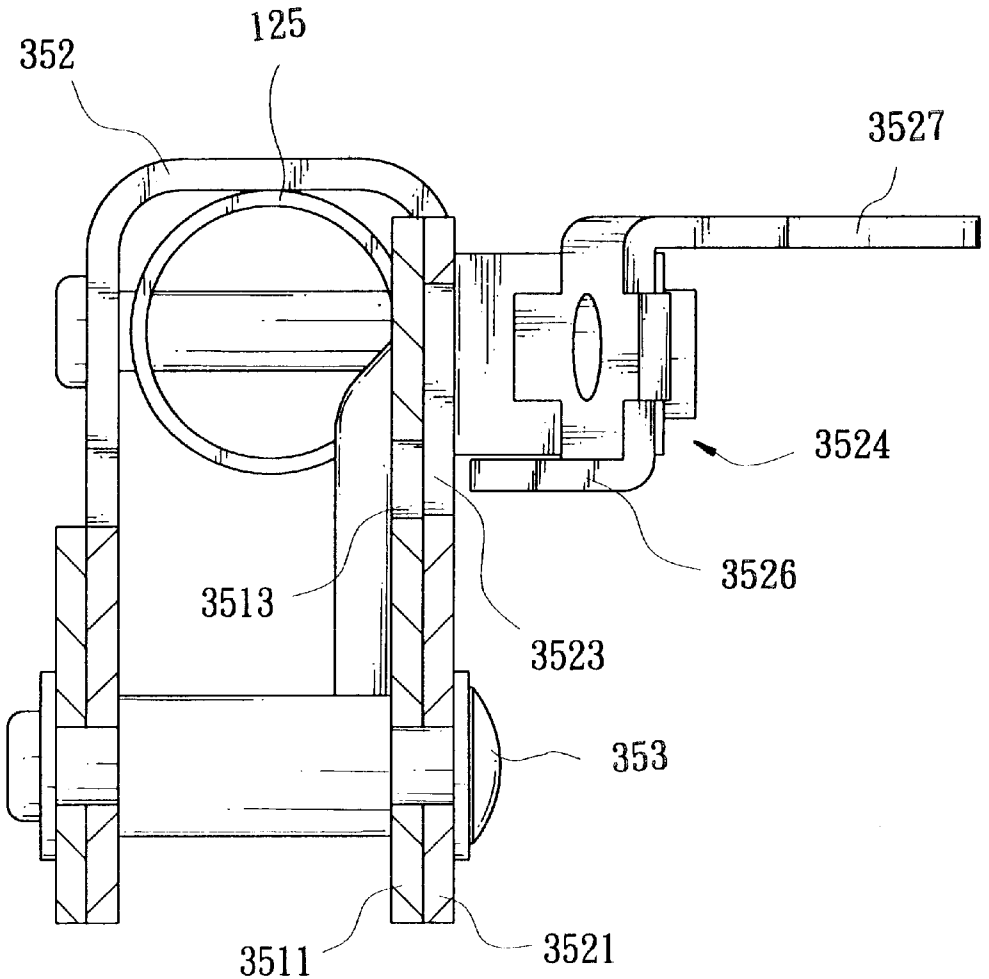
FIG. 5B is an enlarged cutting view of the detailed structure of the joint element of the present invention, depicting the folded position.

As shown in FIGS. 2 and 3, a preferred embodiment of the present invention is composed of an upper frame 11, a lower frame 12, rods 101 104 and a cover sheet 20.

The upper frame 11 is further composed of upper connecting elements 111~114, a plurality of rods 115~118 and 115'~118' and joint elements 31~34 and forms into a rectangular frame. The lower frame 12 is further composed of lower connecting elements 121~124, a plurality of rods 125~128, and 125'~128', and joint elements 35~38 and, forms into another rectangular frame. Supporting rods are located between the upper connecting elements 111~114 and the lower connecting elements 121~124 separately. The upper frame 11, the lower frame 12 and supporting rods 101~104 construct a foldable main frame 10. The cover sheet 20 then encloses all planes of the main frame except the upper plane and forms a play space 100 with an upper opening. An extra supporting seat 13 can be located at the bottom plane of the play space 100. The main frame 10 thus is capable of expanding to form a play space and being folded to downsize and facilitate storage.

As in FIGS. 4A, 4B, 4C, 5A and 5B, the joint elements 35~38, take joint element 35, for sample description hereinafter, of the lower frame 12 is composed of a first connecting portion 351 and a second connecting portion 352. The first connecting portion 351 and the second connecting portion 352 are 'U' shaped in its cutting plane. One end of the first connecting portion 351 and one end of the second connecting portion 352 are connected by a shaft 353, and the other end of the first connecting portion 351 and the other end of the second connecting portion 352 are connected to rods 125 and 125' separately. The rods 125 and 125' can be named lower side rods because they are located at lower side of the main frame 10. There are overlapped extending portions 3511 and 3512 in the connecting portions of the first connecting portion 351 and the second connecting portion 352. A stop element 3512 is located at back of the extending portions 3511 of the first connecting portion 351. When the first connecting portion 351 and the second connecting portion 352 rotate to a position which are coaxial with rods 125 and 125', that is, at the expanded status, the extending portion 3521 of the second connecting portion 352 will reach the stop element 3512 of the first connecting portion 351 in order to restrict that the first connecting portion 351 and the second connecting portion 352 are in the same axial position.

There are holes 3513 and 3523 located on the reduplicated extending portions 3511 and 3521 of the first connecting portion 351 and the second connecting portion 352, respectively. Furthermore, holes 3513 and 3523 pass through each other when the first connecting portion 351 and the second connecting portion 352 are parallelly aligned. A safety pin 3524 is located at the corresponding hole 3523 of the second connecting portion 352. The safety pin 3524 has a spring 3525 which is fixed on a wall of the second connecting portion 352 and has a pin portion 3526 on the other free end. The pin portion 3526 has a corresponding position with holes 3513 and 3523 and is normally insert into holes 3513 and 3523 to hold at the first locking position. In this position, the first connecting portion 351 and the second connecting portion 352 are constrained to be axial. A ring-pull 3527 is located at the rear end of the pin portion 3526 and is pulled to release, or pull back, from holes 3513 and 3523. In this released position, the first connecting portion 351 and the second connecting portion 352 are mutually foldable. Furthermore, when the first connecting portion 351 and the second connecting portion 352 are mutually folded to a coaxial position, a guiding ramp 3514 which is located at the front end of extending portion 3511 of the first connecting portion 351 will push the pin portion 3526 back. The pin portion 3526 will come back to the locking position when holes 3513 and 3523 are mutually reduplicated.

Again, referring to FIGS. 2 and 3, a handle 131 is located at a supporting seat 13 and connected to one end of the pulled element 50 which may be a wire, a rope, a weaving rope or a steel rope and connects to one end of the ring-pull 3527 of the safety pin 3524. All safety pins of joint elements 35 38 are connected by pulled element 50 and handle 131. When the playyard is to be folded up, pulling the handle 131 up will cause the pulled element 50 to move the safety pin 3524 to a released position and all the rods 125~128 and 125'~128' to mutually fold up.

The design of the safety pin of the present invention will securely keep the foldable playyard in its expanded status and prevent rods 125~128 and 125'128' from being folded up due to an accident or malfunction. The design of handle 131 and the pulled element 50 facilitates the operating of pulling the safety pin 3524 to a released position and folding rods 125~128 and 125'~128' up. In FIG. 6, the other end, with respect to the pulled element 50, of the safety pin 3524 can be located not only on the handle 131 but also on cover sheet 20. In the same manner, pulling up the handle 131 will cause the safety pin 3524 to be pulled up via cover sheet 20 and pulled element 50.

Numerous variations and modifications will suggest themselves to persons skilled in the arts, other than those already described, without departing the basic inventive concepts. Although the present invention has been described with respect to typical preferred embodiments thereof, it should be understood that the present inventions is not limited to these embodiments, and various changes or modifications may be made without departing from the scope of the present invention as defined by the appended claims.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A foldable playyard for minimizing malfunctioning when in an expanded status, comprising:

a foldable main frame, which at least comprises an upper frame, a lower frame and a plurality of pairs of rods connecting said upper frame and said lower frame at ends thereof, wherein said upper frame and said lower frame have joint elements therein constructed to be foldable;

a safety pin located at each said joint element of said lower frame, said pin being movable between a locked and an unlocked position, such that said joint element is restricted in its movement when said pin is in the locked position and released when said pin is in the unlocked position, a handle located adjacent to each joint element for carrying said main frame being pulled up; and a pulling element, which is elastic and connected to each said safety pin at one end and said handle at the other end, provided for moving said safety pin to reach said unlocked position when being pulled by said handle;

wherein said safety pin is held in said locked position by being inserted into a pair of holes respectively formed in a pair of connection portions of said joint element of said lower frame, said holes are aligned when said connection portions of said joint element of said lower frame are parallelly aligned.

2. A foldable playyard as described in claim 1, wherein said safety pin is composed of a spring firmly connected to said joint element at one end, a pin portion and a ring-pull located at another end.

3. A foldable playyard as described in claim 1, wherein said pulling element is directly connected to said handle.

4. A foldable playyard as described in claim 1, wherein said pulling element is connected with said handle via cover sheet enclosing said main frame.

5. A foldable playyard as described in claim 1, wherein said pulling element is a woven rope.

6. A foldable playyard as described in claim 1, wherein said pulling element is a rope.

7. A foldable playyard as described in claim 1, wherein said pulling element is a steel rope.

8. A foldable playyard as described in claim 1, wherein said pulling element further connects a ring-pull.

9. A foldable playyard as described in claim 1, wherein said joint element is composed of a first connecting portion and second connecting portion.

10. A foldable playyard as described in claim 1, wherein the end where said first connecting portion and said second connecting portion connect has an extending portion and a guiding ramp is located at one end of said first connecting portion.

* * * * *